US006571504B2

(12) United States Patent
Carlson

(10) Patent No.: US 6,571,504 B2
(45) Date of Patent: Jun. 3, 2003

(54) DUAL POWERED ILLUMINATED FIBER OPTIC GUN SIGHT

(76) Inventor: John T. Carlson, 811 Ashland Avenue, St. Paul, MN (US) 55104

( * ) Notice: Subject to any disclaimer, the term of this patent is extended or adjusted under 35 U.S.C. 154(b) by 4 days.

(21) Appl. No.: 09/845,939

(22) Filed: Apr. 30, 2001

(65) Prior Publication Data

US 2002/0157298 A1 Oct. 31, 2002

(51) Int. Cl.[7] ..... F41G 1/100
(52) U.S. Cl. ..... 42/132; 42/143
(58) Field of Search ..... 42/111–148

(56) References Cited

U.S. PATENT DOCUMENTS

| | | | | | |
|---|---|---|---|---|---|
| 3,678,590 | A | | 7/1972 | Hayward | 33/241 |
| 3,833,799 | A | * | 9/1974 | Audet | 42/132 |
| 3,914,873 | A | | 10/1975 | Elliott, Jr. et al. | 33/241 |
| 4,070,763 | A | | 1/1978 | Carts, Jr. | 33/241 |
| 4,177,572 | A | | 12/1979 | Hindes | 33/265 |
| 4,195,414 | A | * | 4/1980 | Robinson | 33/265 |
| 4,434,560 | A | | 3/1984 | Comeyne | 33/241 |
| 4,495,705 | A | | 1/1985 | Kowalski et al. | 33/265 |
| 4,533,980 | A | | 8/1985 | Hayes | 362/110 |
| 4,945,667 | A | * | 8/1990 | Rogalski et al. | 42/114 |
| 5,058,900 | A | | 10/1991 | Denen | |
| 5,068,969 | A | | 12/1991 | Siebert | 33/241 |
| 5,070,619 | A | * | 12/1991 | Santiago | 42/144 |
| 5,279,061 | A | * | 1/1994 | Betz et al. | 42/132 |
| 5,359,800 | A | * | 11/1994 | Fisher et al. | 42/145 |
| 5,388,364 | A | * | 2/1995 | Paldino | 42/117 |
| 5,419,072 | A | * | 5/1995 | Moore et al. | 42/117 |
| 5,471,777 | A | | 12/1995 | McDonald | 42/103 |
| 5,493,450 | A | * | 2/1996 | Ekstrand | 359/799 |
| RE35,347 | E | * | 10/1996 | Bindon | 42/145 |
| 5,634,278 | A | * | 6/1997 | London | 42/132 |
| 5,924,234 | A | * | 7/1999 | Bindon et al. | 42/123 |
| 5,926,963 | A | * | 7/1999 | Knight | 42/132 |
| 5,956,854 | A | | 9/1999 | Lorocco | 33/241 |
| 5,992,030 | A | * | 11/1999 | Mann | 42/144 |
| 6,014,830 | A | | 1/2000 | Brown et al. | 42/100 |
| 6,035,539 | A | | 3/2000 | Hollenbach et al. | 33/241 |
| 6,041,508 | A | | 3/2000 | David | 33/233 |
| 6,085,427 | A | | 7/2000 | Persson | 33/241 |

OTHER PUBLICATIONS

Poly–Optical Products, Inc. brochure.
Firesights by Williams web page, 2 pages, Jul. 30, 2001.
Truglo web page, Starbrite–bead–sights.htm, Jul. 30, 2001.
Cobra web page, Electralight, 2 pages, Jul. 30, 2001.

* cited by examiner

*Primary Examiner*—Michael J. Carone
*Assistant Examiner*—Denise Buckley
(74) *Attorney, Agent, or Firm*—Gerald E. Helget; Nelson R. Capes; Briggs and Morgan

(57) ABSTRACT

A dual powered fiber optic sight for a gun, which can be illuminated either by ambient light or by a light source. The light source is preferably a light-emitting diode (LED). Ambient light and light from the LED are carried by a fiber optic rod to a target screen and the rod appears as a bright dot on the target screen on the front sight of the gun. An optional rear sight also receives light from the ambient light or from the light source.

11 Claims, 4 Drawing Sheets

DUAL POWERED ILLUMINATED FIBER OPTIC GUN SIGHT

BACKGROUND OF THE INVENTION

The present invention relates to an illuminated open sight for a gun, such as a rifle or shotgun.

present fiber optic gun sights, which function using ambient light, perform good to excellent when there is sufficient existing light. Their performance becomes less effective as the existing light diminishes. At or around daybreak and sunset are good examples of this.

It is well known that you cannot see stars during daylight hours. This is because the light being reflected or generated by the star is not as great as the surrounding light. The surrounding light washes out the light received from the star. When it comes to fiber optic gun sights they tend to fail when you need them the most.

Often times the light produced or collected by a fiber optic gun sight is not sufficient to be seen when the target is a bird flying across a clear blue sky. This can happen when you the shooter might be in the shade of a tree or on the back side of a hill or building. Since existing fiber optic gun sights fail when a good sight picture is needed the most, the need for an optional power source is of utmost importance.

Tritium is a radioisotope of hydrogen and a phosphor glows in the dark. Gun sights using tritium are faint when compared to the light emitted by an LED. Manufacturers of this type of gun sight claim that battery powered systems have a tendency to fail. This may have been the norm but not any more. This gun sight uses batteries that are inexpensive, very obtainable and will perform well beyond 100 hours.

Laser sights are of little value outdoors during daylight hours. They also reveal where you are as the shooter. Red dot sights and scopes do not have the field of view that open sights have. With some it is a struggle locating the red dot inside this tube that you must look through.

U.S. Pat. No. 4,434,560 discloses an aiming aid for an aiming device in a low light level environment. The aiming aid includes a light source that transmits light to fiber optics in a front sight and by a light-scattering rod to fiber optics in the rear sight. However, the patent has the disadvantage that the barrel of the weapon must be extensively modified (i.e., cut out) to accommodate the apparatus. Also, the patent does not disclose the use of ambient light to power the front sight.

There is a need for a dual-powered fiber optic sight for a gun, which can be illuminated either by ambient light or by a light source.

SUMMARY OF THE INVENTION

A dual powered fiber optic sight for a gun, which can be illuminated either by ambient light or by a light source. The light source is preferably a light-emitting diode (LED). Ambient light and light from the LED are carried by a fiber optic rod to a target screen and the rod appears as a bright dot on the target screen on the front sight of the gun.

This system being dual powered has an LED that provides illumination in the instances where existing fiber optic gun sights fail to function adequately. The invention ensures 24 hour performance and does it when it is needed most. This is accomplished by placing an LED at the opposite end of the target screen (front sight). A fiber optic rod becomes a light pipe to transmit light from the LED to the target screen. The rod also transmits ambient light to the target screen. In addition, the rod polarizes the light so that there is much less glare than there would be if you were looking directly into the LED.

In mode one or when ambient light is sufficient, the fiber optic rod which emits green light will appear green on the target screen. In mode two or when the ambient light generated is less than the surrounding light, the LED will take over and appears as a red dot on the target screen, red being the color emitted by the LED.

The illuminated dot is surrounded by a black target screen, which has two beneficial advantages. First, it provides more contrast between the illuminated dot and the surrounding area. Open sights often blend in with the surroundings, making it more difficult to see the sight. Another advantage of this target screen is that it encourages the shooter to aim and shoot with both eyes open (because the target screen blocks the target from view by the sighting eye). Most experienced shooters using open sights suggest that you keep both eyes open. It is faster and optimizes the unlimited field of view that you have with open sights. With both eyes open you can prepare your second shot at the same time you are taking the first shot.

The batteries uses by this invention are inexpensive, very obtainable, and will perform well beyond 100 hours. Even if the sight is left on over night, there will be plenty of power to get through a long weekend of hunting. Even if the batteries run out, the sight can still be powered by ambient light.

The surface mounted device (SMD) LED is mounted on a flex circuit to ensure reliability. The LED has a life estimated at 100,000 hours, or more than eleven (11) years of continuous use.

The sight is designed so that it can be completely disassembled without any tools or wrenches. Since all parts are accessible, any mechanical or electrical problem can be pinpointed by the user with a basic understanding of the system.

Many hunters have given up hunting because they have problems seeing the sights. As we age our eyes' ability to focus on more than one object becomes more and more difficult. A system that provides a bright sight is easier to see, both consciously and unconsciously.

DETAILED DESCRIPTION OF THE PREFERRED EMBODIMENT

Figure 1:
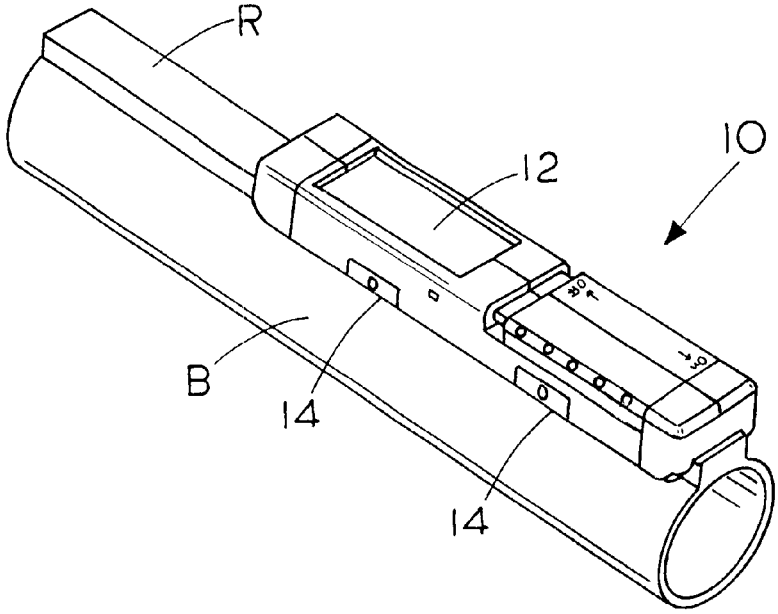
FIG. 1 is a front perspective view of a first embodiment of the present invention.

The dual-powered, illuminated open sight of the present invention is generally shown in the Figures as reference numeral 10.

A first embodiment of the present invention has a front sight only, and is mounted directly to the gun barrel.

FIG. 1 shows that the sight 10 may be mounted on the barrel B of a gun. A typical mounting utilizes the rail R on the barrel B, which is found on guns such as shotguns. Holding members 14 such as screws may attach the sight 10 to the rail R. However, other mounts are possible. In any case, the sight 10 can be mounted on the gun barrel B without significantly modifying the gun barrel.

The sight 10 further comprises a window 12 adapted to gather ambient light. The window 12 may be made of any material that transmits ambient light, such as glass or plastic.

The sight 10 further comprises an artificial light source 16. The artificial light source 16 is preferably a light-emitting diode 18. The preferred LED is a Stanley Model number BR1113F (red). Others include PG1113F (green) and PY1113F (yellow).

The sight 10 further comprises a target screen 20. Preferably, the target screen presents a dark or black surface to the light from the ambient or artificial light source, to improve contrast.

Figure 2:
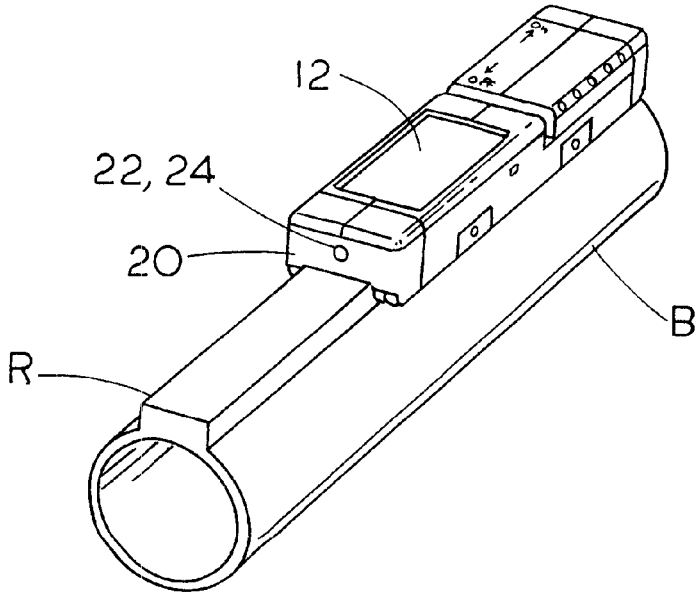
FIG. 2 is a rear perspective view of a first embodiment of the present invention.
Figure 3:
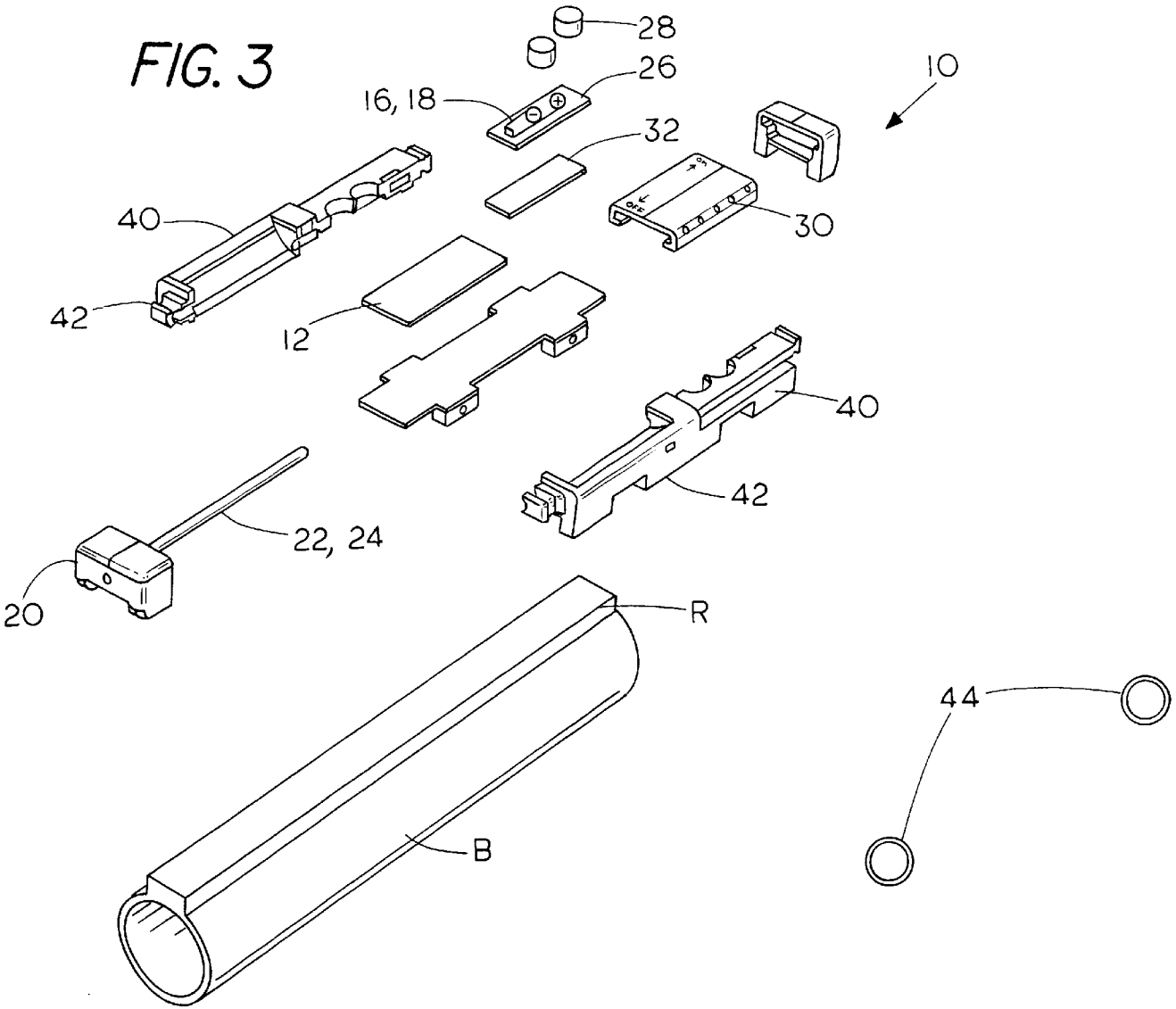
FIG. 3 is an exploded perspective view of a first embodiment of the present invention.

The sight 10 further comprises a fiber optic device 22 adapted to transmit light from the window 12 and from the artificial light source 16 to the target screen 20. The fiber optic device 22 appears as an illuminated dot on the target screen 20 (see FIG. 2). Preferably, the fiber optic device 22 is a monofilament plastic rod 24. A suitable rod is obtainable from Poly-optical Products, Inc., 17475 Gillette Ave., Irvine, Calif. 92614-5612 (OPTIBRIGHT® Scintillating Fibers). The rod is preferably about 2 mm in diameter.

The LED 18 is preferably mounted on a flexible circuit 26, which also provides a contact for the batteries 28. The flexible circuit cooperates with a sliding switch 30 to turn the LED on and off. A piece of foam tape 32 may be inserted to act as a spring for the sliding switch.

A housing 40 encloses the window 12, LED 18, fiber optic device 22, flexible circuit 26, and batteries 28. The sliding switch 30 forms a portion of the housing 40. O-rings 44 hold the halves 42 of the housing 40 together and enable the user to assemble and disassemble the sight 10 without the use of tools.

If the fiber optic device 22 has a green color and the LED is red, the fiber optic device will appear green when illuminated by ambient light (mode 1) and red when illuminated by the LED (mode 2). As the ambient light decreases, the fiber optic device will turn from green to red. This occurs at the point where the ambient light is approximately equal to the light from the LED. White light may be briefly transmitted during the shift from mode 1 to mode 2, if there is enough yellow light coming from the fiber optic device to form the three primary colors (red, green, and yellow). It may be desirable to have the LED and the fiber optic device be the same color in order to avoid this white light effect.

When (2) #10 hearing aid batteries 28 are placed in series they should produce 2.8 volts. When two of these batteries are placed under the load of a Stanley BR1113F SMD LED 18, the voltage drops to 1.6 volts. By nature of this combination the LED 18 draws less current and the result is far more battery life. The battery life of this combination is between 100 and 125 hours of continuous use.

Figure 4:
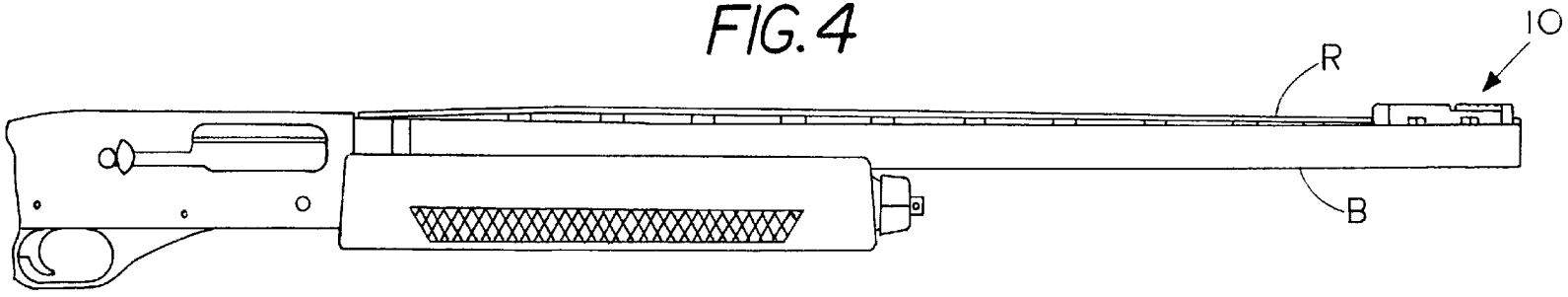
FIG. 4 is a side elevational view of a gun barrel with the first embodiment mounted thereon.

FIG. 4 shows the sight 10 mounted on the rib R of a shotgun.

A second embodiment of the present invention includes a rear sight, and the rear sight is also mounted directly on the gun barrel.

Figure 5:
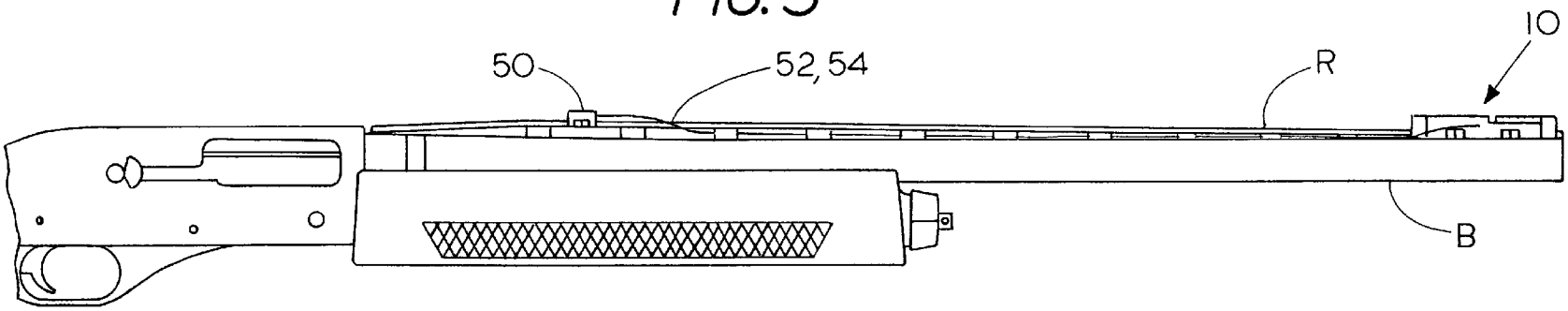
FIG. 5 is similar to FIG. 4, showing a second embodiment of the present invention.
Figure 6:
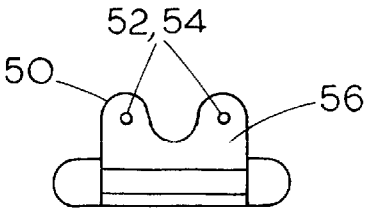
FIG. 6 is an elevational view of the rear sight of FIG. 5.

FIG. 5 shows the second embodiment, which adds a rear sight 50, also mounted on the rib R of the shotgun. A second fiber optic device 52, 54 connects the front sight 10 to the rear sight 50. This may be a monofilament plastic rod 24 as described above. FIG. 6 shows a detail of the rear sight 50. There may be two rods 52 and 54, in which case two illuminated dots are presented on the rear target screen 56, as shown in the Figure. The rods or filaments 52 and 54 are preferably 1 mm and may be encased in a protective covering such as 3M heat shrink tubing from Minnesota Mining an Manufacturing, Inc., St. Paul, Minn. The filaments 52 and 54 and protective covering may be woven between the supports of the rib R.

A third embodiment of the present invention has the front sight and rear sight mounted on rails which extend above the gun barrel.

Figure 7:
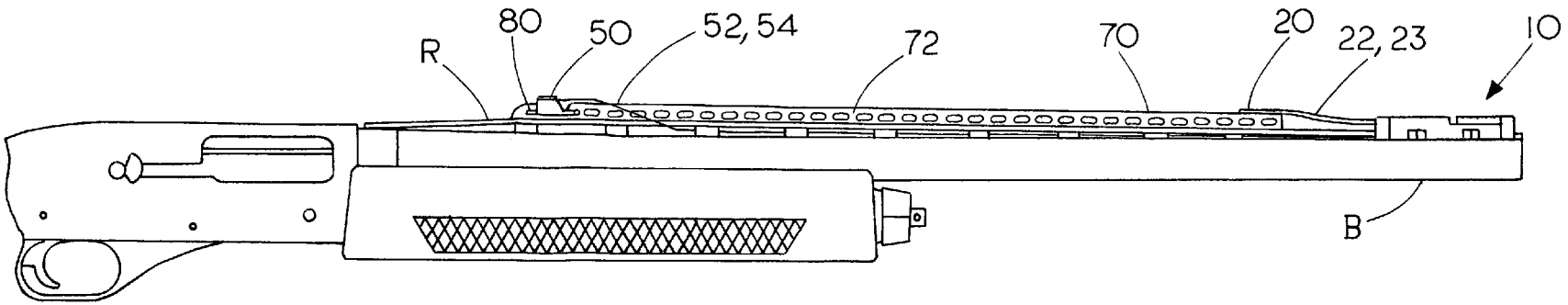
FIG. 7 is similar to FIG. 5, but shows a third embodiment of the present invention.

FIG. 7 shows the third embodiment in which the front sight 10 is modified so that the fiber optic device 22 extends above the standard shotgun rib R. In this case, the fiber optic device 22 is extended outside the housing 40 as an extension 23, which may typically be two to three inches longer. The extension 23 is mounted on a rail 70 which in turn is mounted on the rib R. No target screen is used in this case. Because the fiber optic device 22 is approximately three inches longer, it appears much brighter. Also, the rear sight 50 is mounted on a second rail 72, which in turn is mounted on the rib R. The rails 70, 72 may butt together and may be mounted to the rib R by tape such as (0.020) 3M-VHB Tape from Minnesota Mining and Manufacturing, Inc., St. Paul, Minn. The rear sight 50 may slide into a slot 80 in the second rail 72. This makes the rear sight interchangeable for elevation. Windage can be adjusted by sliding the rear sight 50 to the left or right inside the slot 80.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A dual-powered, illuminated open sight for a gun, that can be attached to the gun barrel the gun sight comprising:

a) a window adapted to gather ambient light;

b) an artificial light source;

c) a target screen; and d) a fiber optic device adapted to transmit light from the window and from the artificial light source to the target screen, the fiber optic device appearing as an illuminated dot on the target screen;

e) a housing having lateral opposing halves with o-rings holding the housing halves together.

2. The gun sight of claim 1, wherein the artificial light source is a light-emitting diode.

3. The gun sight of claim 1, wherein the fiber optic device is a monofilament plastic rod.

4. The gun sight of claim 2, further comprising a flexible circuit on which the light-emitting diode is mounted and further comprising batteries mounted on the flexible circuit.

5. The gun sight of claim 4, further comprising a sliding switch connecting the batteries to the light-emitting diode.

6. The gun sight of claim 5, further comprising the housing enclosing the window, light-emitting diode, fiber optic device, flexible circuit, and batteries, the sliding switch forming a portion of the housing.

7. The gun sight of claim 2, wherein the fiber optic device has a green color and wherein the light-emitting diode is red, whereby the fiber optic device will appear green when illuminated by ambient light and will appear red when illuminated by the light-emitting diode.

8. The gun sight of claim 1, wherein the artificial light source further comprises a light-emitting diode.

9. The gun sight of claim 8, further comprising a flexible circuit on which the light-emitting diode is mounted and further comprising batteries mounted on the flexible circuit.

10. The gun sight of claim 9, further comprising a sliding switch connecting the batteries to the light-emitting diode.

11. The gun sight of claim 8, wherein the fiber optic device has a green color and wherein the light-emitting diode is red, whereby the fiber optic device will appear green when illuminated by ambient light and will appear red when illuminated by the light-emitting diode.

* * * * *